US009480389B2

(12) United States Patent
Haft et al.

(10) Patent No.: US 9,480,389 B2
(45) Date of Patent: Nov. 1, 2016

(54) CONNECTOR FOR A DISHWASHER MIDDLE SPRAY ARM

(71) Applicant: Wolf Appliance, Inc., Fitchburg, WI (US)

(72) Inventors: Thomas Haft, Madison, WI (US); Janusz Sendor, New Bern, NC (US); Colin R. Clerkin, Waunakee, WI (US); Gerry Lippincott, Milton, WI (US); Brian Wylie, Stoughton, WI (US); Randall Koplin, Fitchburg, WI (US); Stephen Latham, Sun Prairie, WI (US); Kent Kallsen, Jefferson, WI (US)

(73) Assignee: Wolf Appliance, Inc., Fitchburg, WI (US)

( * ) Notice: Subject to any disclaimer, the term of this patent is extended or adjusted under 35 U.S.C. 154(b) by 786 days.

(21) Appl. No.: 13/925,147

(22) Filed: Jun. 24, 2013

(65) Prior Publication Data

US 2014/0373883 A1 Dec. 25, 2014

(51) Int. Cl.
*A47L 15/42* (2006.01)
*A47L 15/50* (2006.01)

(52) U.S. Cl.
CPC ..... *A47L 15/508* (2013.01)

(58) Field of Classification Search
CPC . A47L 15/23; A47L 15/508; A47L 15/4221; A47L 15/4225; A47L 15/4282
USPC .. 134/56 D, 58 D, 198, 172, 25.2, 57 D, 18, 134/184, 176, 200, 201, 180, 183, 144, 134/111; 312/228, 228.1, 271, 273; 211/41.8
See application file for complete search history.

(56) References Cited

U.S. PATENT DOCUMENTS

| | | | |
|---|---|---|---|
| 4,064,887 | A | 12/1977 | Geiger et al. |
| 5,823,211 | A | 10/1998 | Wilhelmstätter et al. |
| 6,431,188 | B1 * | 8/2002 | Laszczewski, Jr. ... A47L 15/508 134/144 |
| 6,612,009 | B1 | 9/2003 | Laszczewski, Jr. et al. |
| 6,869,029 | B2 | 3/2005 | Ochoa, Sr. et al. |
| 7,055,537 | B2 | 6/2006 | Elick et al. |
| 8,166,983 | B2 | 5/2012 | Clerkin |
| 2007/0215187 | A1 | 9/2007 | Koch et al. |
| 2008/0142056 | A1 | 6/2008 | Dries et al. |

(Continued)

FOREIGN PATENT DOCUMENTS

| | | |
|---|---|---|
| DE | 4137227 | 5/1993 |
| EP | 0401767 | 12/1990 |

(Continued)

*Primary Examiner* — David Cormier
*Assistant Examiner* — Thomas Bucci
(74) *Attorney, Agent, or Firm* — Bell & Manning, LLC

(57) ABSTRACT

A docking system includes basket and wall conduit systems. The basket conduit system includes a conduit and first and second nozzles mounted to opposite ends of the conduit. The second nozzle has a first funnel shape with a first circumference that decreases from an open end of the second nozzle towards the conduit. The wall conduit system includes front and back housings, a sliding plate, and a third nozzle. A sliding aperture is formed through a front plate of the front housing. A nozzle aperture is formed through a back plate of the back housing. The sliding plate slides within a space formed by the front housing and the back housing. The third nozzle is sized and shaped to slide within the sliding aperture and includes a generally cylindrical shape and a second funnel shape with a second circumference that decreases from the sliding plate towards the generally cylindrical shape.

20 Claims, 14 Drawing Sheets

(56) References Cited

U.S. PATENT DOCUMENTS

| | | | | |
|---|---|---|---|---|
| 2008/0163904 | A1* | 7/2008 | Hwang | A47L 15/508 134/198 |
| 2009/0090400 | A1 | 4/2009 | Burrows et al. | |
| 2012/0097198 | A1* | 4/2012 | Schmidt | A47L 15/508 134/144 |
| 2013/0068265 | A1* | 3/2013 | Gnadinger | A47L 15/508 134/184 |
| 2014/0196756 | A1* | 7/2014 | Dries | A47L 15/22 134/198 |

FOREIGN PATENT DOCUMENTS

| | | |
|---|---|---|
| EP | 1110497 | 6/2001 |
| WO | WO2009/004034 | 1/2009 |
| WO | WO2009/008827 | 1/2009 |

* cited by examiner

CONNECTOR FOR A DISHWASHER MIDDLE SPRAY ARM

BACKGROUND

Typically, appliances such as dishwashers are provided with an interior wash chamber or tub, and have one or more racks, or baskets, that are designed to hold dishware within the interior of the tub during operation of the dishwasher. The baskets may slide out of the tub so that the consumer can load dishware for cleaning. Some baskets may be adjustable vertically in height relative to a bottom of the tub to accommodate various size dishes within the tub.

To effectively clean the dishware, one or more spray assemblies are typically provided. Each spray assembly typically includes a rotating spray arm that is fluidly connected to a pump though one or more conduits. The pump supplies fluid to the spray arm, which in turn sprays dishwashing fluid and/or water onto the dishware in the basket(s). Some baskets may support a spray assembly. Complex coupling features and additional components are typically required to properly couple the spray assemblies to the fluid supply system when the basket is adjustable in height.

SUMMARY

In an example embodiment, a spray arm docking system is provided. The spray arm docking system may include, but is not limited to, a basket conduit system and a wall conduit system. The basket conduit system is configured to mount to a basket of a dishwasher. The basket conduit system may include, but is not limited to, a conduit, a first nozzle mounted to a first end of the conduit, and a second nozzle mounted to a second end of the conduit. The first nozzle is configured to mount to an input nozzle of a spray arm of the dishwasher. The second nozzle has a first funnel shape with a first circumference that decreases from an open end of the second nozzle towards the second end of the conduit. The wall conduit system is configured to mount to a wall of the dishwasher. The wall conduit system may include, but is not limited to, a front housing, a back housing, a sliding plate, and a third nozzle. The front housing may include, but is not limited to, a front plate. A sliding aperture is formed through the front plate. The back housing may include, but is not limited to, a back plate configured to abut the wall of the dishwasher. A nozzle aperture is formed through the back plate and is configured to receive a nozzle. The sliding plate is mounted between the front plate and the back plate to slide within a space formed by the front housing and the back housing. An aperture is formed through the sliding plate. The third nozzle is sized and shaped to slide within the sliding aperture. The third nozzle may include, but is not limited to, a first nozzle portion and a second nozzle portion. The first nozzle portion is mounted to extend from the sliding plate in a direction towards the front housing and surrounds the aperture of the sliding plate. The second nozzle portion is mounted to extend from the first nozzle portion. The second nozzle portion may include, but is not limited to, a conduit section having a generally cylindrical shape. The first nozzle portion has a second funnel shape with a second circumference that decreases from the sliding plate towards the conduit section of the second nozzle portion. The conduit section of the second nozzle portion extends within the second end of the conduit of the basket conduit system when the basket conduit system is mounted to the wall conduit system.

In another example embodiment, a dishwasher is provided. The dishwasher may include, but is not limited to, a body, a door, a hinge pivotally mounting the door to the body, a fluid supply system mounted to the body, a basket slidably mounted within the body, a spray arm, a basket conduit system, and a wall conduit system. The fluid supply system may include, but is not limited to, a pump, a conduit mounted to the pump, and a nozzle extending from the conduit. A height of the basket within the body is adjustable. The spray arm may include, but is not limited to, an input nozzle.

The basket conduit system is configured to mount to the basket. The basket conduit system may include, but is not limited to, a basket conduit, a first nozzle mounted to a first end of the basket conduit, and a second nozzle mounted to a second end of the basket conduit. The first nozzle is configured to mount to the input nozzle of the spray arm. The second nozzle has a first funnel shape with a first circumference that decreases from an open end of the second nozzle towards the second end of the basket conduit.

The wall conduit system is configured to mount to a back wall of the body. The wall conduit system may include, but is not limited to, a front housing, a back housing, a sliding plate, and a third nozzle. The front housing may include, but is not limited to, a front plate. A sliding aperture is formed through the front plate. The back housing may include, but is not limited to, a back plate configured to abut the back wall. A nozzle aperture is formed through the back plate and is configured to receive the nozzle. The sliding plate is mounted between the front plate and the back plate to slide within a space formed by the front housing and the back housing. An aperture is formed through the sliding plate.

The third nozzle is sized and shaped to slide within the sliding aperture. The third nozzle may include, but is not limited to, a first nozzle portion and a second nozzle portion. The first nozzle portion is mounted to extend from the sliding plate in a direction towards the front housing and surrounds the aperture of the sliding plate. The second nozzle portion is mounted to extend from the first nozzle portion. The second nozzle portion may include, but is not limited to, a conduit section having a generally cylindrical shape. The first nozzle portion has a second funnel shape with a second circumference that decreases from the sliding plate towards the conduit section of the second nozzle portion. The conduit section of the second nozzle portion extends within the second end of the basket conduit when the basket is slid into the body.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
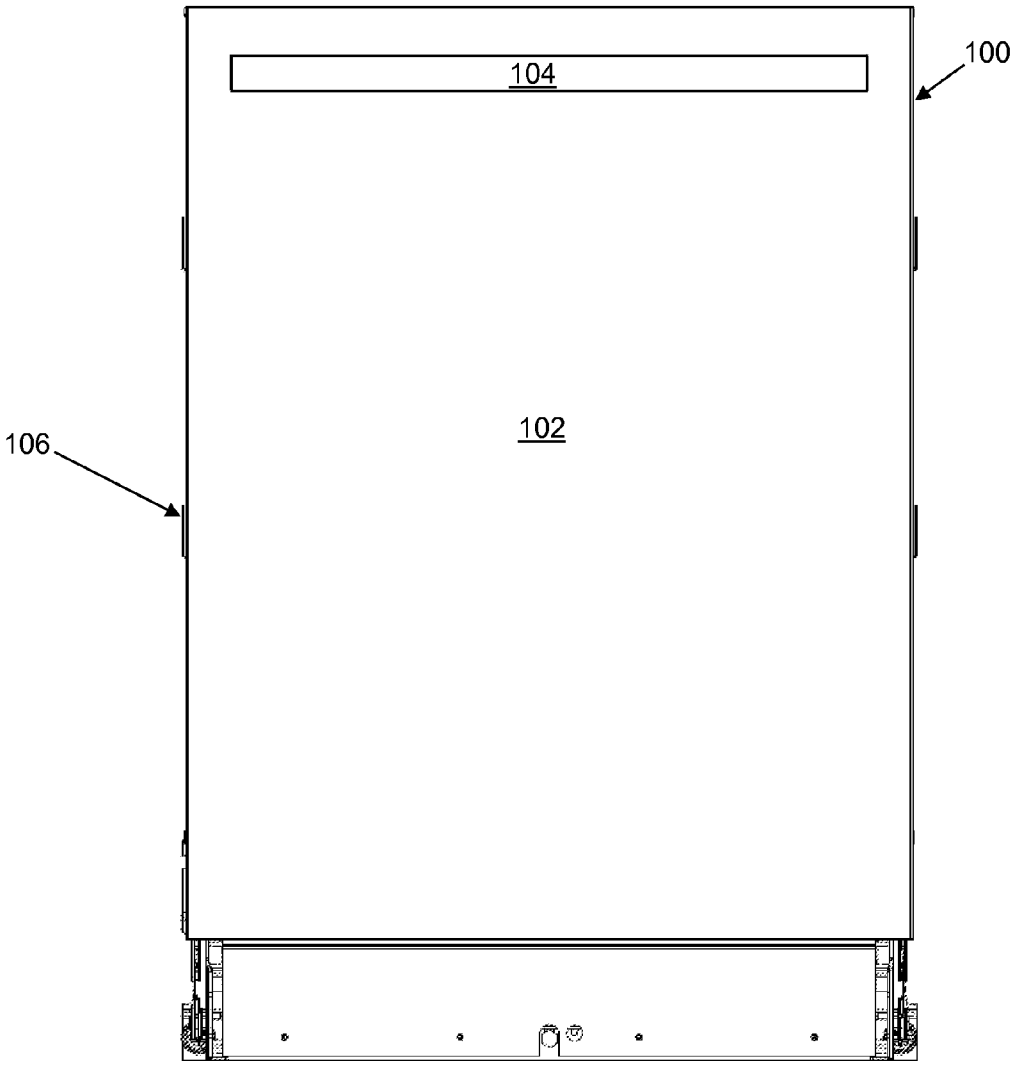
FIG. 1 depicts a front view of a dishwasher in accordance with an illustrative embodiment.

With reference to FIG. 1, a dishwasher 100 is shown in accordance with an illustrative embodiment. With reference to FIG. 1, dishwasher 100 may include a door 102, a handle 104, and a body 106. Handle 104 may be mounted to door 102 near a top of door 102 to facilitate opening of door 102, which rotates from a vertical position, as shown in FIG. 1, to a horizontal position (not shown) as understood by a person of skill in the art. A plurality of hinges (not shown) pivotally mount door 102 to body 106 proximate a lower edge of door 102. Use of directional terms, such as top, bottom, right, left, front, back, etc. are merely intended to facilitate reference to the various surfaces of the described structures relative to the orientations shown in the drawings and are not intended to be limiting in any manner.

As used herein, the term "mount" includes join, unite, connect, couple, associate, insert, hang, hold, affix, attach, fasten, bind, paste, secure, bolt, screw, rivet, solder, weld, glue, form over, layer, mold, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact). Elements referenced as mounted to each other herein may further be integrally formed together, for example, using a molding or thermoforming process as understood by a person of skill in the art. As a result, elements described herein as being mounted to each other need not be discrete structural elements. The elements may be mounted permanently, removably, or releasably.

Dishwasher 100 may include a greater or a fewer number of components than those illustrated. The one or more components of dishwasher 100 may be formed of one or more materials, such as various metals, glass, and/or plastics having a sufficient strength and rigidity to support the described application. In the illustrative embodiment, body 106 includes a plurality of walls that, in combination with door 102, form an enclosed space or wash tub. As understood by a person of skill in the art, the walls that form dishwasher 100 may include insulation to suppress noise created by dishwasher 100.

Figure 2:
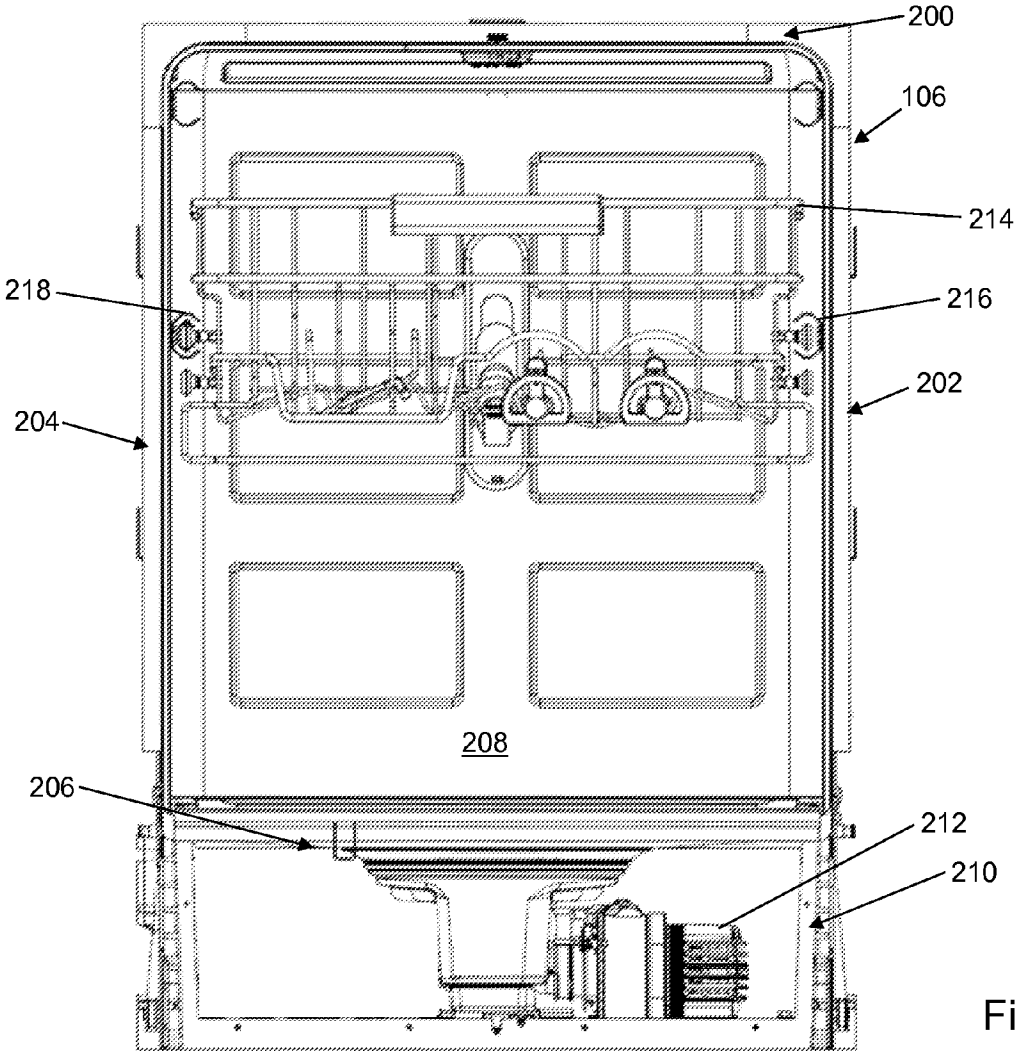
FIG. 2 depicts a front view of the dishwasher of FIG. 1 without a door in accordance with an illustrative embodiment.

With reference to FIG. 2, the plurality of walls of body 106 may include a top wall 200, a right side wall 202, a left side wall 204, a tub bottom wall 206, and a back wall 208. Top wall 200, right side wall 202, left side wall 204, tub bottom wall 206, and back wall 208 define a wash tub. A base 210 may provide a support platform for door 102 and the wash tub, as well as other components of dishwasher 100. Base 210 further may define a space below the wash tub within which various components may be mounted such as a pump 212.

Door 102 rotates downward to provide access to the wash tub. The wash tub may include one or more baskets on which dishware or other items are placed for washing and/or rinsing. For example, dishwasher 100 includes a top basket 214. Of course, dishwasher 100 may include one or more baskets above and/or below top basket 214. As understood by a person of skill in the art, top basket 214 can be slid into and out of the wash tub using a variety of mounting methods. In the illustrative embodiment, top basket 214 is slid in and out of dishwasher 100 using a right side rail 216 mounted to right side wall 202 and a left side rail 218 mounted to left side wall 204. Additionally, a height of top basket 214 within body 106 and relative to tub bottom wall 206 is adjustable as understood by a person of skill in the art. Thus, top basket 214 may be moved up and down along back wall 208.

Figure 3:
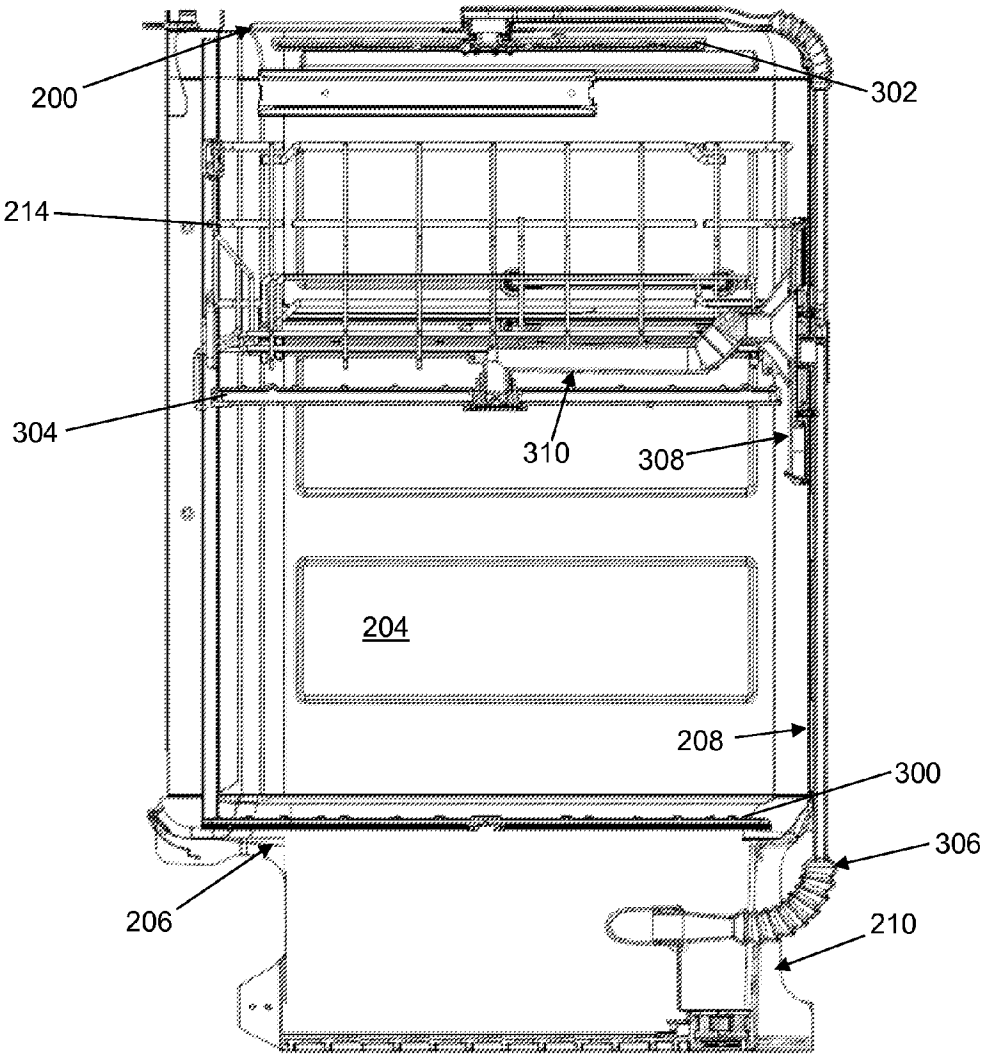
FIG. 3 depicts a right side view of the dishwasher of FIG. 2 without a right side wall in accordance with an illustrative embodiment.

With reference to FIG. 3, the wash tub may include one or more spray arms that spray a washing fluid on the dishware loaded on the one or more baskets. For example, dishwasher 100 includes a lower spray arm 300, an upper spray arm 302, and a middle spray arm 304. Lower spray arm 300 is mounted to extend up from tub bottom wall 206 and is configured to spray the washing fluid upward as understood by a person of skill in the art. Upper spray arm 302 is mounted to extend down from top wall 200 and is configured to spray the washing fluid downward as understood by a person of skill in the art. Middle spray arm 304 is mounted below top basket 214 and configured to spray the washing fluid upward onto dishware loaded in top basket 214 as understood by a person of skill in the art. Middle spray arm 304 further may be configured to spray the washing fluid downward onto dishware loaded in a bottom basket (not shown) as understood by a person of skill in the art. Dishwasher 100 may include a fewer or a greater number of baskets and spray arms.

A fluid supply system may include pump 212, a conduit 306, a wall conduit system 308, and a basket conduit system 310. Conduit 306 is mounted to pump 212 and extends up back wall 208 from base 210 to top wall 200. Upper spray arm 302 is mounted to receive fluid pumped by pump 212 through conduit 306. Wall conduit system 308 is also mounted to receive fluid pumped by pump 212 through conduit 306. Middle spray arm 304 is mounted to receive fluid pumped by pump 212 through conduit 306, wall conduit system 308, and basket conduit system 310. Though not shown, lower spray arm 300 is mounted to receive fluid pumped by pump 212 through conduit 306 or through one or more additional conduits (not shown).

As understood by a person of skill in the art, lower spray arm 300, upper spray arm 302, and middle spray arm 304 include one or more arms or extensions, each having a plurality of apertures or holes therein, that distribute the washing fluid to the dishware within dishwasher 100. Lower spray arm 300, upper spray arm 302, and middle spray arm 304 may be configured to rotate during operation and may take a variety of shapes, sizes, and configurations to suit particular applications. The fluid that is sprayed out of lower spray arm 300, upper spray arm 302, and middle spray arm 304 may be collected in a reservoir at a bottom of tub bottom wall 206 and, if desired, recirculated by the fluid supply system using pump 212.

Figure 4:
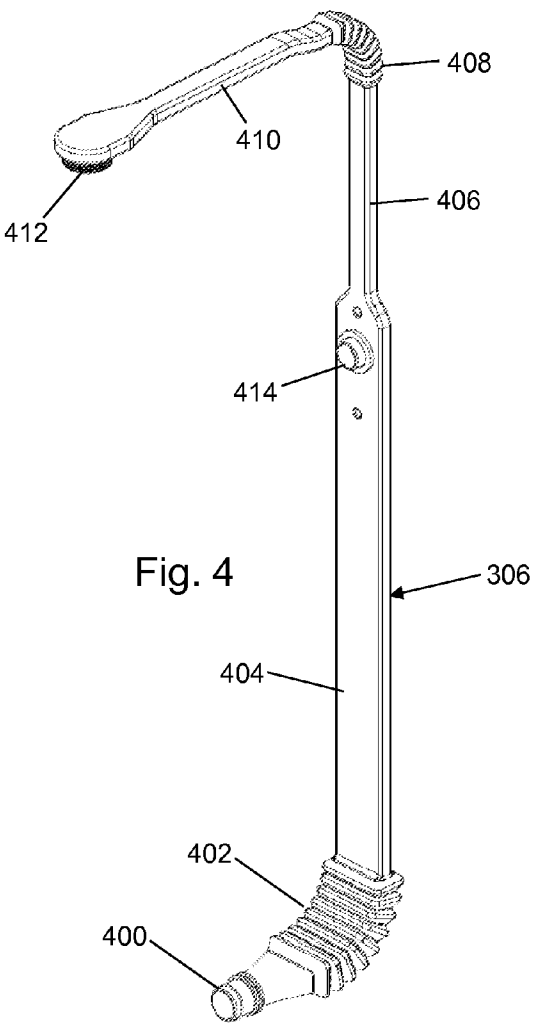
FIG. 4 depicts a perspective view of a conduit of the dishwasher of FIG. 1 in accordance with an illustrative embodiment.

With reference to FIG. 4, conduit 306 may include a first nozzle 400, a first transition conduit 402, a first conduit section 404, a second conduit section 406, a second transition conduit 408, a third conduit section 410, a second nozzle 412, and a third nozzle 414. First nozzle 400 mounts to pump 212. For example, first nozzle 400 mounts to pump 212 using a hose. Upper spray arm 302 is mounted to second nozzle 412 to receive fluid pumped by pump 212 through conduit 306. Wall conduit system 308 is mounted to third nozzle 414 to receive fluid pumped by pump 212 through conduit 306.

First transition conduit 402 extends from first nozzle 400 and provides a transition section that changes the direction of conduit 306 from generally horizontal to generally vertical to extend up back wall 208 from base 210. Second transition conduit 408 extends between second conduit section 406 and third conduit section 410 and provides a transition section that changes the direction of conduit 306 from generally vertical to generally horizontal to extend across a top surface of top wall 200. Second nozzle 412 is mounted to third conduit section 410. Third nozzle 414 is mounted to first conduit section 404. Second conduit section 406 extends from first conduit section 404 above third nozzle 414. Second conduit section 406 has a smaller circumference than first conduit section 404 because it is providing the fluid to second nozzle 412; whereas, first conduit section 404 is providing the fluid to both second nozzle 412 and third nozzle 414.

Figure 5:
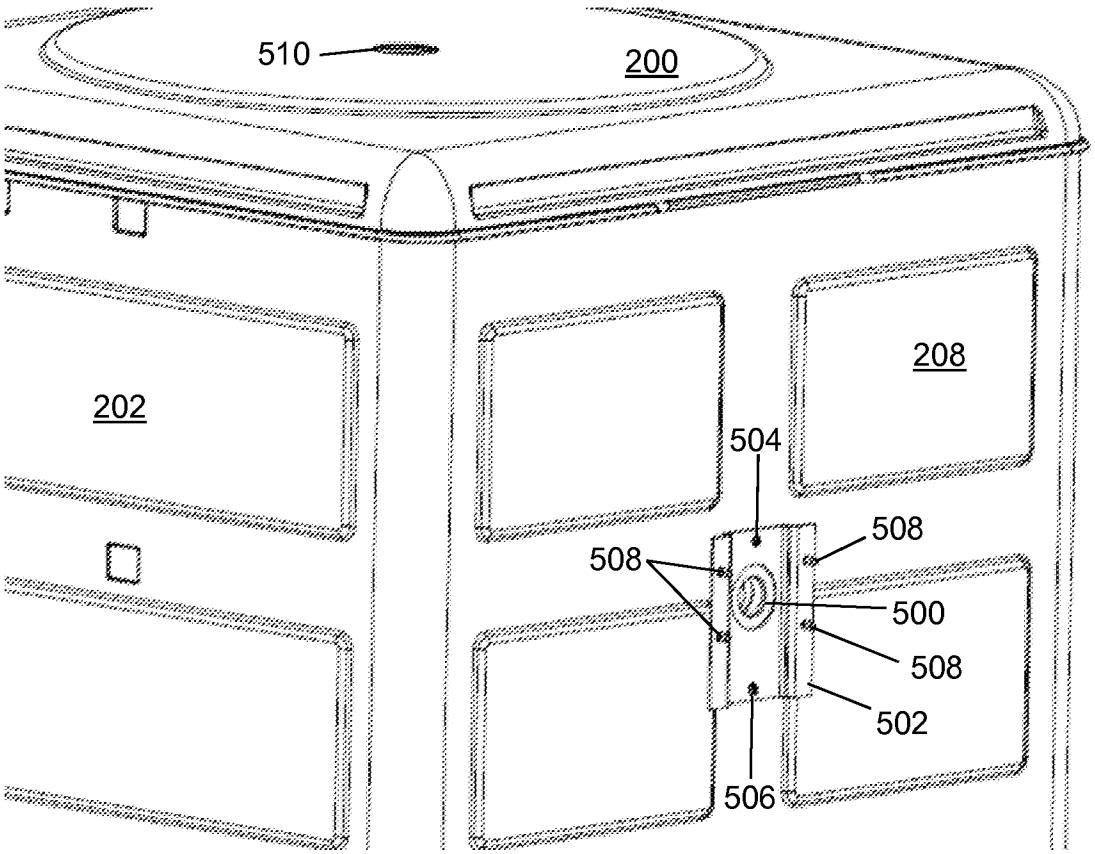
FIG. 5 depicts a back, right perspective view of the dishwasher of FIG. 1 zoomed to show a back wall without the conduit of FIG. 4 in accordance with an illustrative embodiment.

With reference to FIG. 5, a back, right side perspective view of dishwasher 100 is shown zoomed to show an upper portion of back wall 208 without conduit 306 in accordance with an illustrative embodiment. A first nozzle aperture 500 is formed through back wall 208 through which the fluid is provided to wall conduit system 308. A second nozzle aperture 510 is formed through top wall 200 through which the fluid is provided to upper spray arm 302. A bracket 502 is mounted to surround first nozzle aperture 500. A first fastener 504 and a second fastener 506 are inserted in corresponding apertures formed through bracket 502 to mount bracket 502 to back wall 208. Bracket 502 further may include a plurality of fasteners 508. In the illustrative embodiment, the plurality of fasteners 508 are threaded clinch standoffs.

Figure 6:
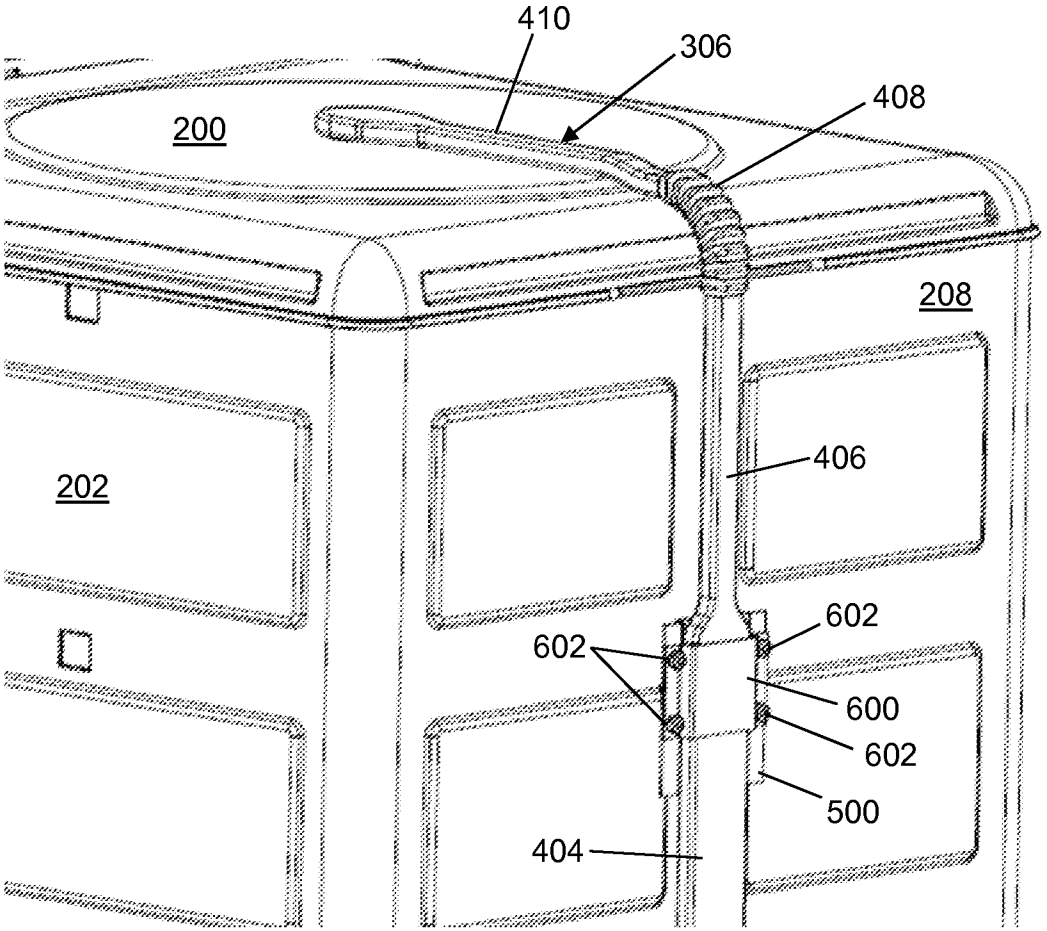
FIG. 6 depicts a back, right perspective view of the dishwasher of FIG. 1 zoomed to show a back wall with the conduit of FIG. 4 in accordance with an illustrative embodiment.

With reference to FIG. 6, a back, right side perspective view of dishwasher 100 is shown zoomed to show an upper portion of back wall 208 with conduit 306 mounted to back wall 208 in accordance with an illustrative embodiment. A mounting plate 600 is mounted over an upper portion of first conduit section 404 of conduit 306 and held in place using nuts 602 threaded onto the plurality of fasteners 508 of bracket 502. Of course, a variety of fasteners and/or mounting methods may be used to mount conduit 306 to dishwasher 100 as understood by a person of skill in the art.

Figure 7:
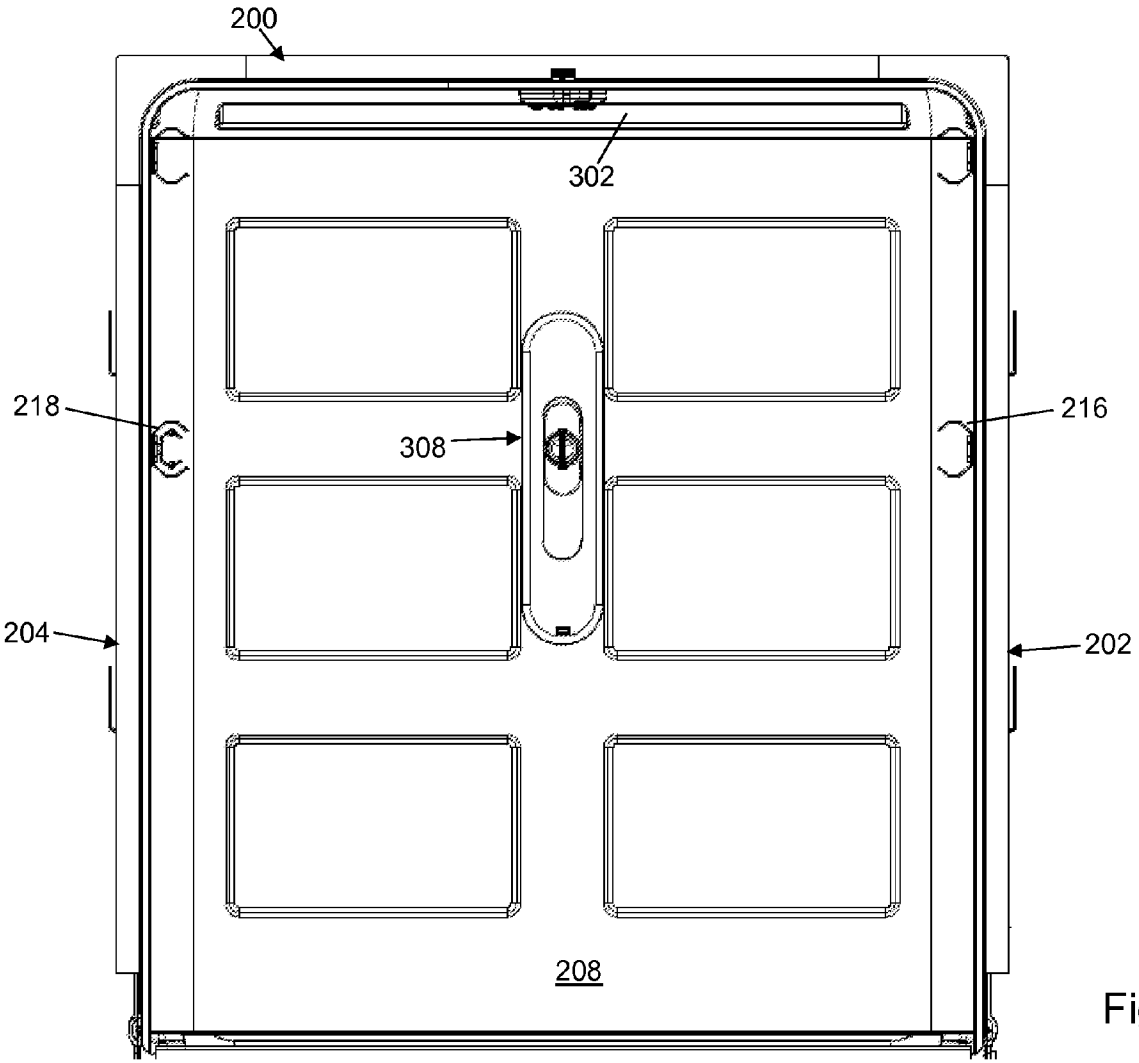
FIG. 7 depicts a front view of the dishwasher of FIG. 1 showing a wall conduit system in accordance with an illustrative embodiment.
Figure 8:
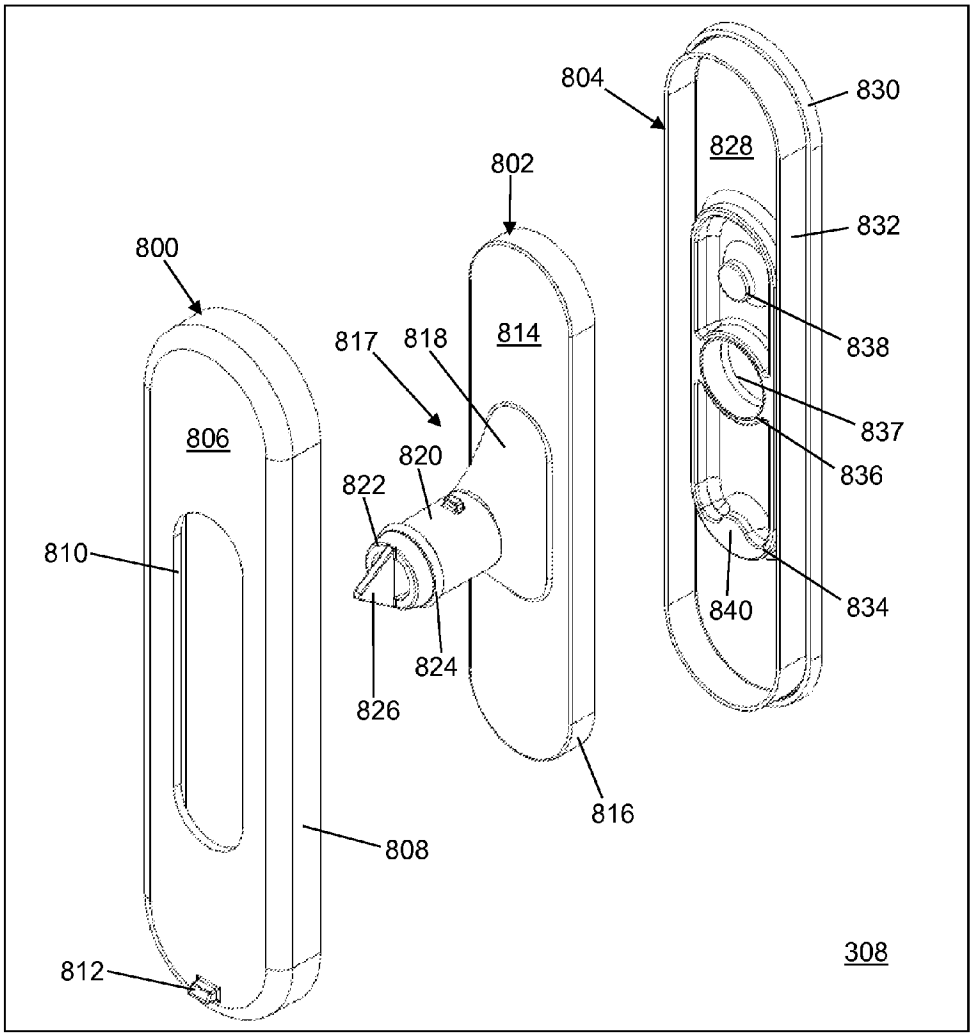
FIG. 8 depicts an exploded view of the wall conduit system of FIG. 7 in accordance with an illustrative embodiment.
Figure 10A:
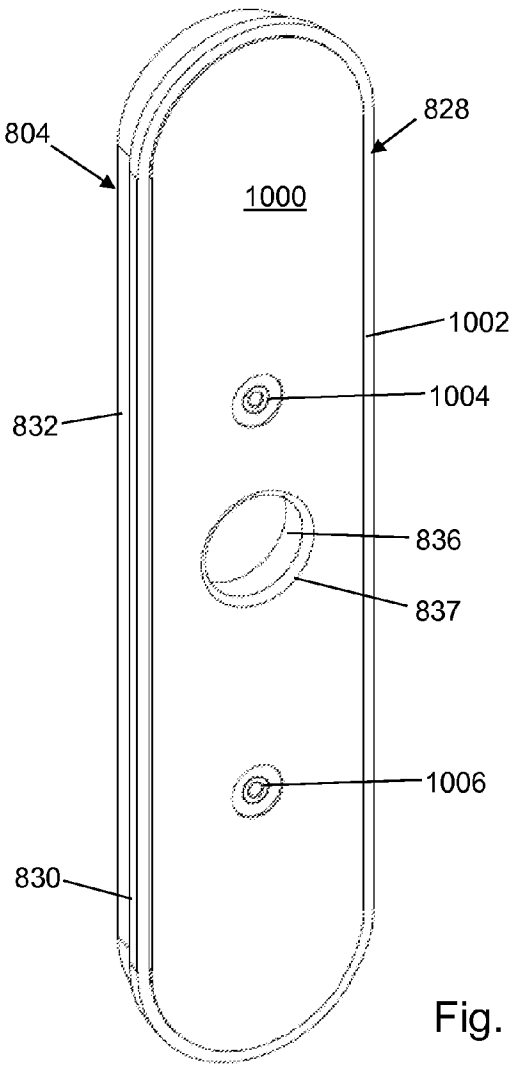
FIG. 10*a* depicts a back perspective view of a back housing of the wall conduit system of FIG. 7 in accordance with an illustrative embodiment.
Figure 10C:
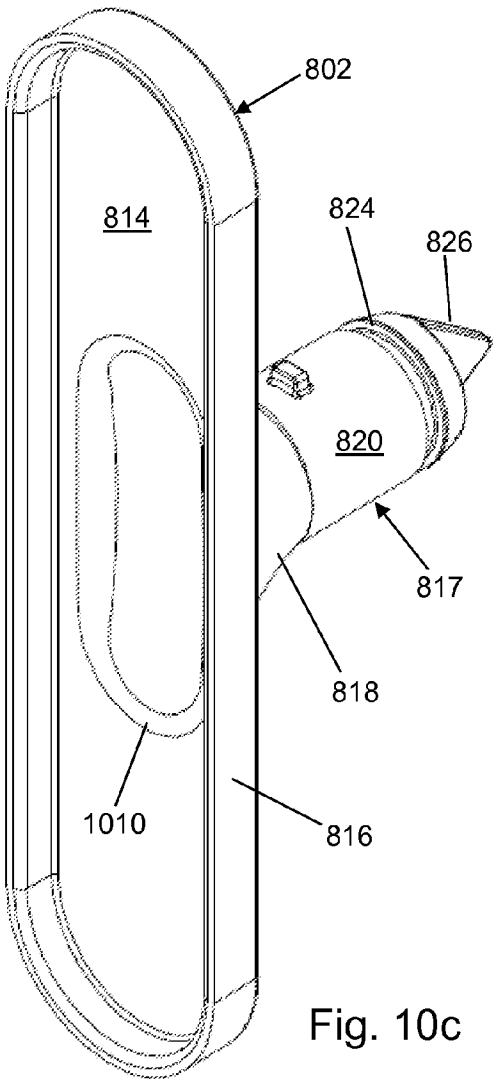
FIG. 10*c* depicts a back perspective view of a sliding mechanism of the wall conduit system of FIG. 7 in accordance with an illustrative embodiment.
Figure 10B:
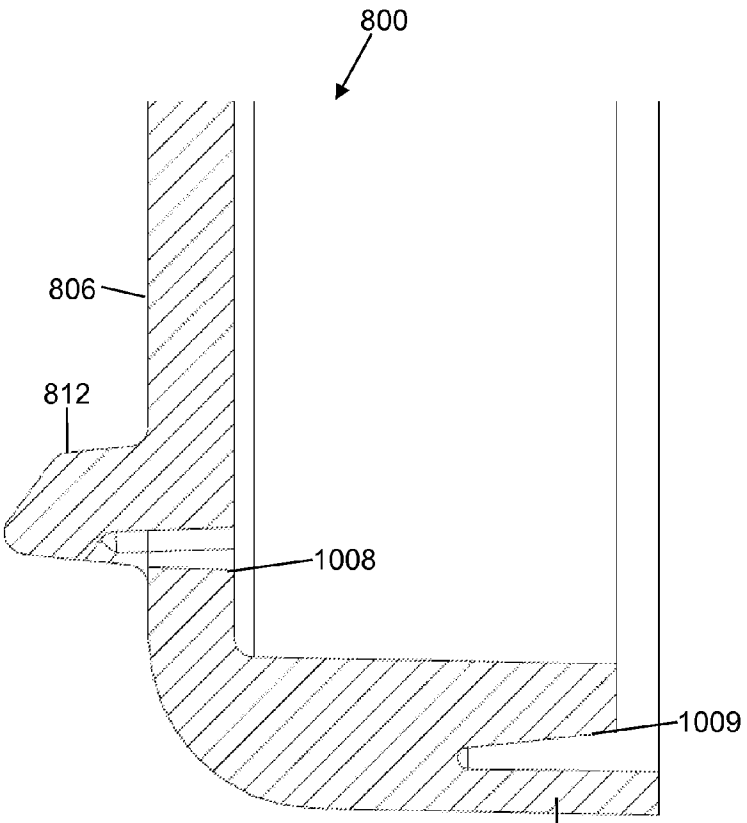
FIG. 10*b* depicts a zoomed right side view of a front housing of the wall conduit system of FIG. 7 in accordance with an illustrative embodiment.

With reference to FIG. 7, wall conduit system 308 is shown mounted to back wall 208. With reference to FIG. 8, an exploded view of wall conduit system 308 is shown in accordance with an illustrative embodiment. Wall conduit system 308 may include a front housing 800, a sliding mechanism 802, and a back housing 804. Front housing 800 may include a front plate 806, a first wall 808, a sliding aperture 810, and a hood 812. First wall 808 extends from an edge of front plate 806 in a direction towards back housing 804. Sliding aperture 810 is formed through front plate 806. Hood 812 extends from a lower portion of front plate 806 in a direction opposite first wall 808. With reference to FIG. 10*b*, a drain nozzle 1008 is formed through front plate 806 and a slot 1009 is formed in first wall 808. Hood 812 surrounds an upper portion of drain nozzle 1008. Drain nozzle 1008 provides a drain for fluid that collects between front housing 800 and back housing 804 and may also spray fluid on dishes below drain nozzle 1008 when dishwasher 100 is operated.

With continuing reference to FIG. 8, sliding mechanism 802 is mounted between front housing 800 and back housing 804 to slide within a space formed by front housing 800 and back housing 804. Sliding mechanism 802 may include a sliding plate 814, a second wall 816, and a fourth nozzle 817. Second wall 816 extends from an edge of sliding plate 814 in a direction towards back housing 804. With reference to FIG. 10*c*, a third nozzle aperture 1010 is formed through sliding plate 814 of sliding mechanism 802.

With continuing reference to FIG. 8, fourth nozzle 817 may include a first nozzle portion 818 and a second nozzle portion 820. First nozzle portion 818 is mounted to extend from sliding plate 814 in a direction towards front housing 800 and surrounds third nozzle aperture 1010 formed through sliding plate 814. First nozzle portion 818 has a funnel shape with a circumference that decreases from sliding plate 814 towards second nozzle portion 820. Second nozzle portion 820 is mounted to extend from first nozzle portion 818. Second nozzle portion includes a conduit section having a generally cylindrical shape that extends between first nozzle portion 818 and a fourth nozzle aperture 822. A sealing ring 824 is mounted in a groove 1100 (shown with reference to FIG. 11) formed in second nozzle portion 820. For example, sealing ring 824 may be an O-ring. An edge of a triangular plate 826 is mounted across fourth nozzle aperture 822. The remaining edges of triangular plate 826 point towards front housing 800.

Back housing 804 may include a back plate 828, a third wall 830, a fourth wall 832, a fifth wall 834, a fifth nozzle 836, a fifth nozzle aperture 837, a first protrusion 838, and a second protrusion 840. With reference to FIG. 10*a*, back housing 804 further may include a back sealing plate 1000, a back edge 1002, a first fastener aperture 1004, and a second fastener aperture 1006. Fifth nozzle aperture 837 is formed through back sealing plate 1000. Fifth nozzle 836 is formed through back plate 828 and extends from fifth nozzle aperture 837 in a direction towards front housing 800. Fifth nozzle 836 and fifth nozzle aperture 837 are sized and shaped to receive third nozzle 414 of conduit 306. Back edge 1002 is a portion of a back surface of back plate 828 that extends outward relative to back sealing plate 1000.

Third wall 830 extends from back edge 1002 of back plate 828 in a direction towards front housing 800. Fourth wall 832 extends from back plate 828 in the direction towards front housing 800 generally parallel to third wall 830. Fifth wall 834 extends from back plate 828 in the direction towards front housing 800 generally parallel to third wall 830 and fourth wall 832. Third wall 830, fourth wall 832, fifth wall 834 have oval shapes with third wall 830 outside fourth wall 834, which is outside fifth wall 834. Fifth nozzle 836 extends within fifth wall 834.

First protrusion 838 and second protrusion 840 extend from back plate 828 in the direction towards front housing 800. Threaded inserts may be sonically welded into first fastener aperture 1004 formed in first protrusion 838 and into second fastener aperture 1006 formed in second protrusion 840 of back plate 828. First fastener 504 is inserted through first fastener aperture 1004 and thereby into first protrusion 838. Second fastener 506 is inserted through second fastener aperture 1006 and thereby into second protrusion 840.

Figure 9:
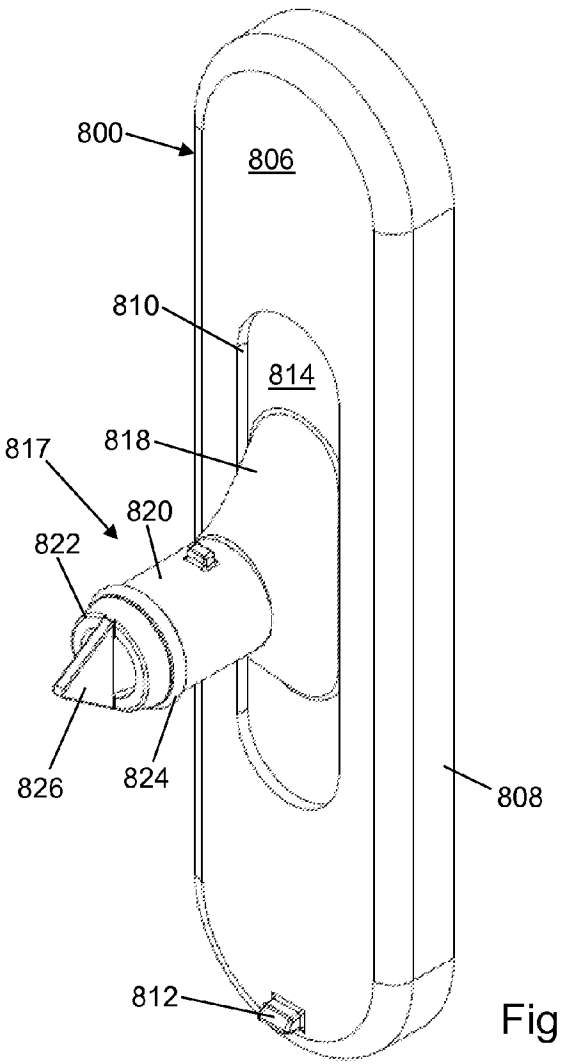
FIG. 9 depicts a front perspective view of the wall conduit system of FIG. 7 in accordance with an illustrative embodiment.

With reference to FIG. 9, a perspective view of wall conduit system 308 is shown in accordance with an illustrative embodiment. In the illustrative embodiment, front plate 806, sliding plate 814, and back plate 828 have similar oval shapes though other shapes may be used. Sliding plate 814 is smaller than front plate 806 and back plate 828 so that sliding plate 814 can slide up and down between front plate 806 and back plate 828.

Figure 11:
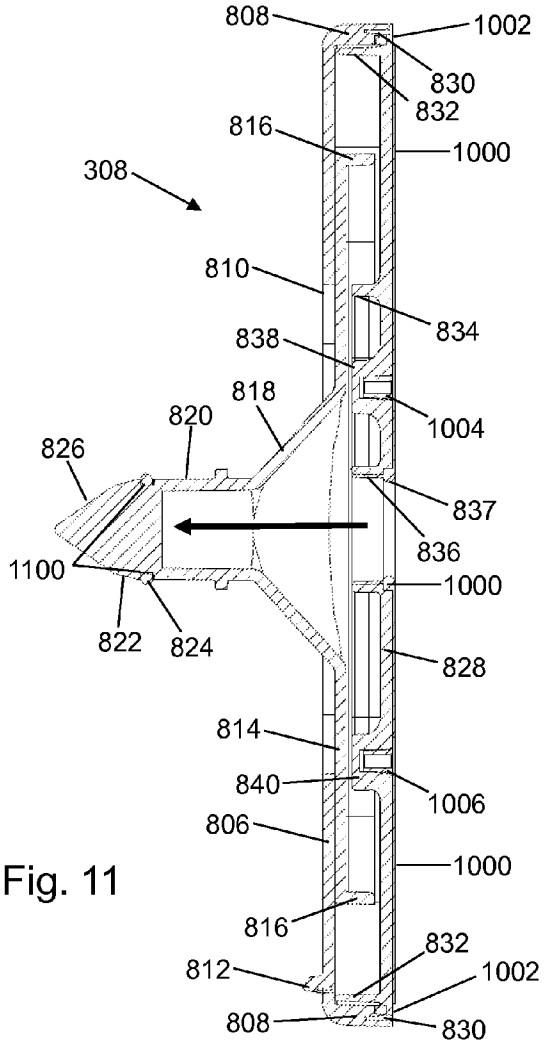
FIG. 11 depicts a right side cross sectional view of the wall conduit system of FIG. 7 in accordance with an illustrative embodiment.

With reference to FIG. 11, a side cross sectional view of wall conduit system 308 is shown in accordance with an illustrative embodiment. Front housing 800, sliding mechanism 802, and back housing 828 may be injection molded. To assemble wall conduit system 308, sliding mechanism 802 is inserted between front plate 806 and back plate 828 so that fourth nozzle 817 extends through sliding aperture 810. Fourth nozzle 817 is sized and shaped to slide within the sliding aperture while continuously covering fifth nozzle 836 so that the fluid from conduit 306 is provided to basket conduit system 810 through fourth nozzle 817. After insertion of sliding mechanism 802, front plate 806 and back plate 828 are mounted together, for example, using a plastic welding technique such as hot plate or vibration welding. First wall 808 of front housing 800 abuts an outside surface of fourth wall 832 and third wall 830 slides into slot 1009 formed in first wall 808. Additionally, in an illustrative embodiment, slot 1009 accepts expunged plastic from third wall 830 of back housing 804 during the plastic welding process.

Back sealing plate 1000 may be overmolded onto back plate 828 and formed of an elastomeric material such as Santoprene™. Back sealing plate 1000 provides the sealing surface for wall conduit system 308 against back wall 208 of dishwasher 100. First fastener 504 and second fastener 506 mount wall conduit system 308 to back wall 208 by pressing back sealing plate 1000 against back wall 208 and inserting first fastener 504 and second fastener 506 through bracket 502, through back wall 208, and into first fastener aperture 1004 and second fastener aperture 1006 of back plate 828.

Third nozzle 414 is inserted into fifth nozzle aperture 837 and fifth nozzle 836 to provide the fluid to fourth nozzle 817. Fifth nozzle aperture 837 may be formed of an elastomeric material such as Santoprene™ to provide a seal against third nozzle 414. Conduit 306 is held in place by mounting plate 600 mounted over the upper portion of first conduit section 404 of conduit 306 and held in place using nuts 602 threaded onto the plurality of fasteners 508 of bracket 502. Other mounting methods may be used to mount the components of wall conduit system 308 to each other, to back wall 208, and/or to conduit 306.

Figure 12:
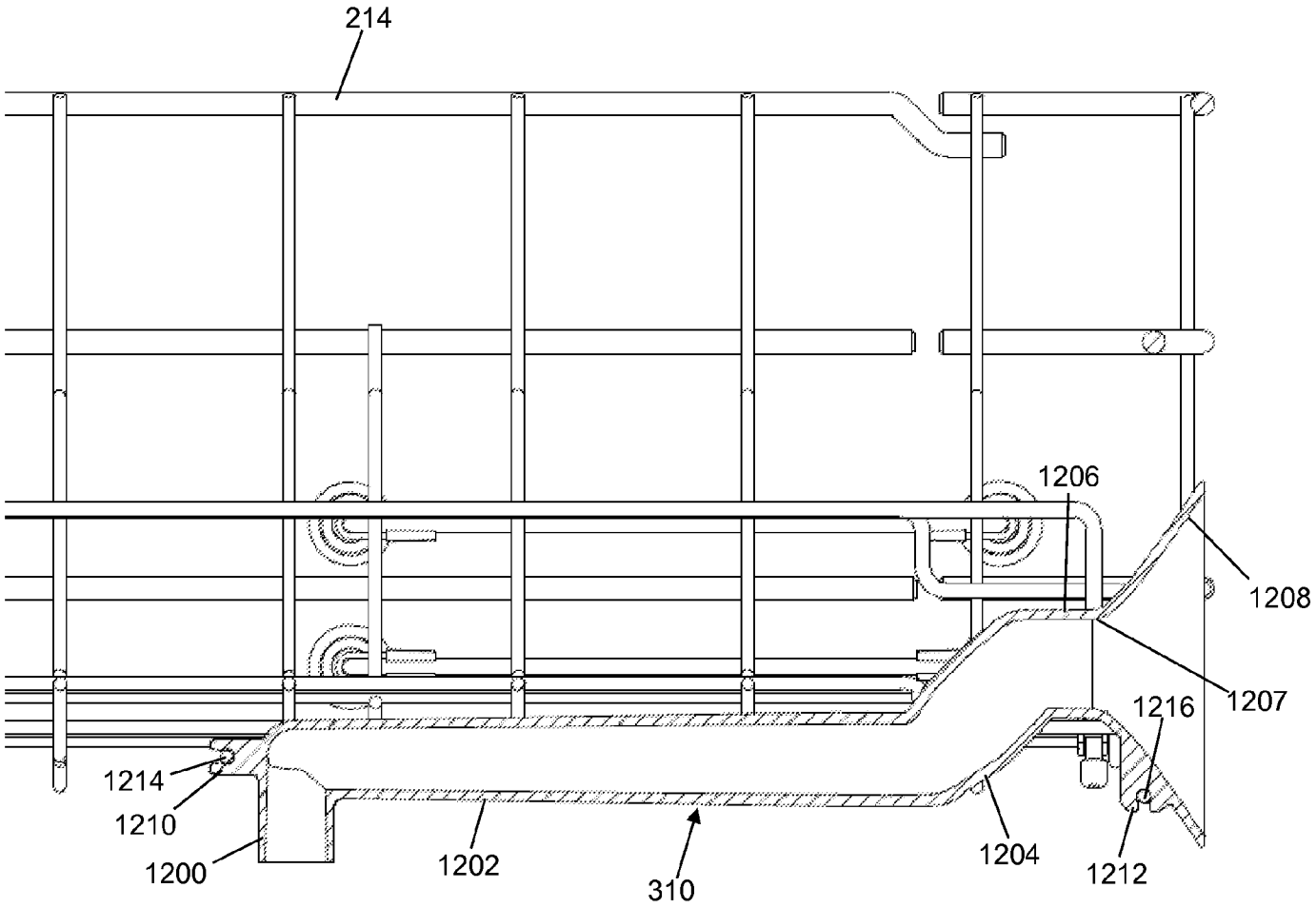
FIG. 12 depicts a right side cross sectional view of a basket conduit system of the dishwasher of FIG. 1 in accordance with an illustrative embodiment.

With reference to FIG. 12, basket conduit system 310 is shown mounted to top basket 214. Basket conduit system 310 may include a sixth nozzle 1200 sized and shaped to mate with an input nozzle (not shown) of middle spray arm 304 as understood by a person of skill in the art. In an illustrative embodiment, sixth nozzle 1200 is generally cylindrical in shape and mounted to direct the fluid in a generally vertical direction. At an opposite end, basket conduit system 310 may include a funnel shaped nozzle 1208.

Between sixth nozzle 1200 and funnel shaped nozzle 1208, basket conduit system 310 may include a fourth conduit section 1202, a third transition conduit 1204, and a fifth conduit section 1206. Fourth conduit section 1202 is generally cylindrical in shape and mounted to direct the fluid in a generally horizontal direction. Fourth conduit section 1202 extends between sixth nozzle 1200 and third transition conduit 1204. Fifth conduit section 1206 is generally cylindrical in shape and mounted to direct the fluid in a generally horizontal direction. Fifth conduit section 1206 extends between funnel shaped nozzle 1208 and third transition conduit 1204. Third transition conduit 1204 extends between fourth conduit section 1202 and fifth conduit section 1206 and provides a transition section that adjusts the height of basket conduit system 310 above tub bottom wall 206. In alternative embodiments, basket conduit system 310 may include a greater or a fewer number of conduit sections and/or transition conduits. In an illustrative embodiment, a radius of basket conduit system 310 may decrease from a first end 1207 of fifth conduit section 1206 to an opening of sixth nozzle 1200.

Basket conduit system 310 may be injection molded and formed of one or more segments. A first valley 1210 and a second valley 1212 may be formed in an outer surface of basket conduit system 310. For example, first valley 1210 may be molded to an outer surface of sixth nozzle 1200, and second valley 1212 may be molded to an outer surface of funnel shaped nozzle 1208. A first tine 1214 mounted to top basket 214 may snap fit into first valley 1210. A second tine 1216 mounted to top basket 214 may snap fit into second valley 1212. Thus, in an illustrative embodiment, basket conduit system 310 is mounted to top basket 214 at first tine 1214 and at second tine 1216. Of course, other mounting methods and locations may be used to mount basket conduit system 310 to top basket 214.

Figure 13:
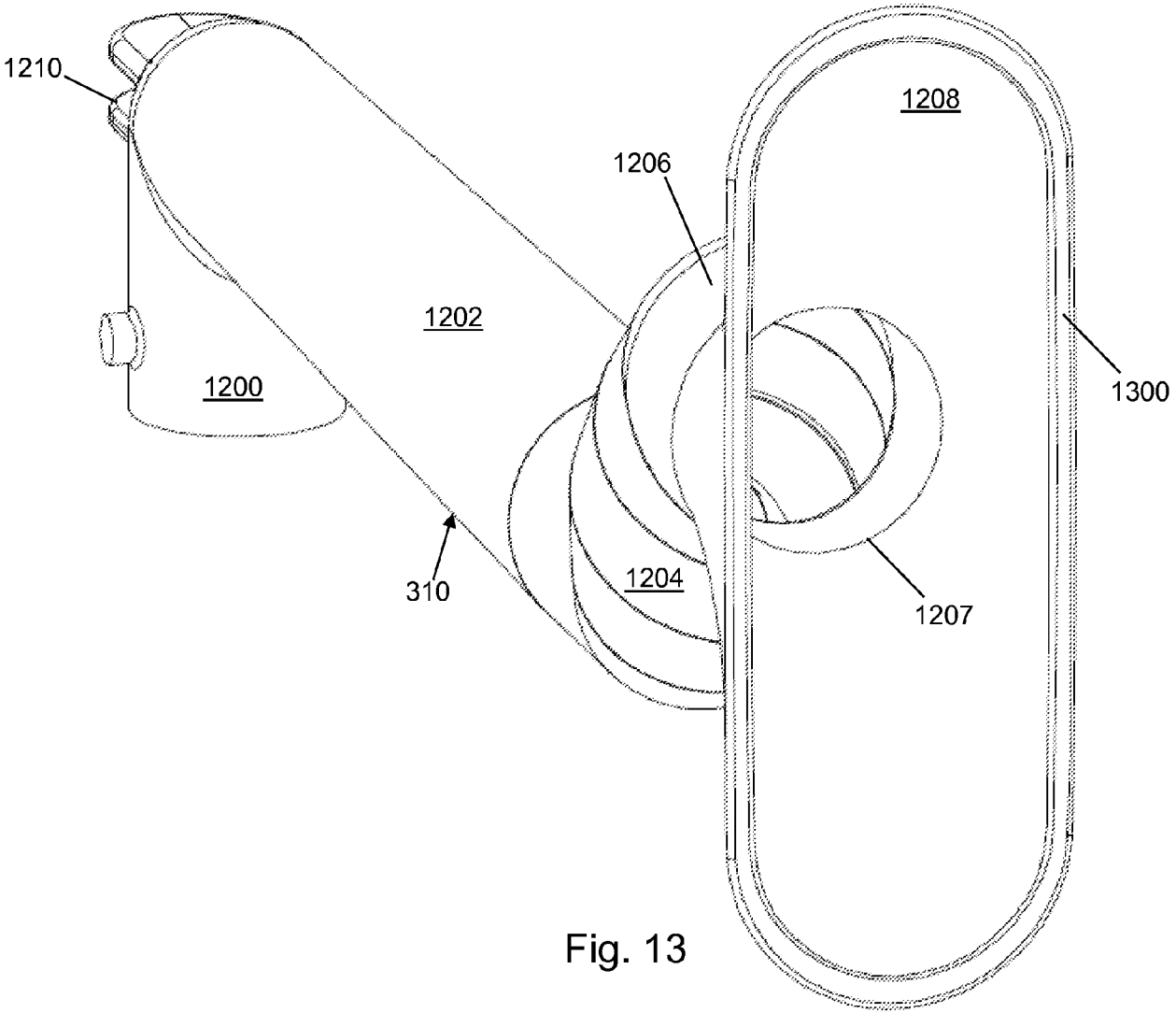
FIG. 13 depicts a back perspective view of the basket conduit system of FIG. 12 in accordance with an illustrative embodiment.

With reference to FIG. 13, a back perspective view of basket conduit system 310 is shown in accordance with an illustrative embodiment. Funnel shaped nozzle 1208 has an oval shaped edge 1300. Funnel shaped nozzle 1208 has a circumference that decreases from oval shaped edge 1300 towards first end 1207 of fifth conduit section 1206. Oval shaped edge 1300 contacts front plate 806. Thus, oval shaped edge 1300 has a circumference that is larger in at least one dimension relative to the circumference of sliding aperture 810 of front plate 806.

Figure 14:
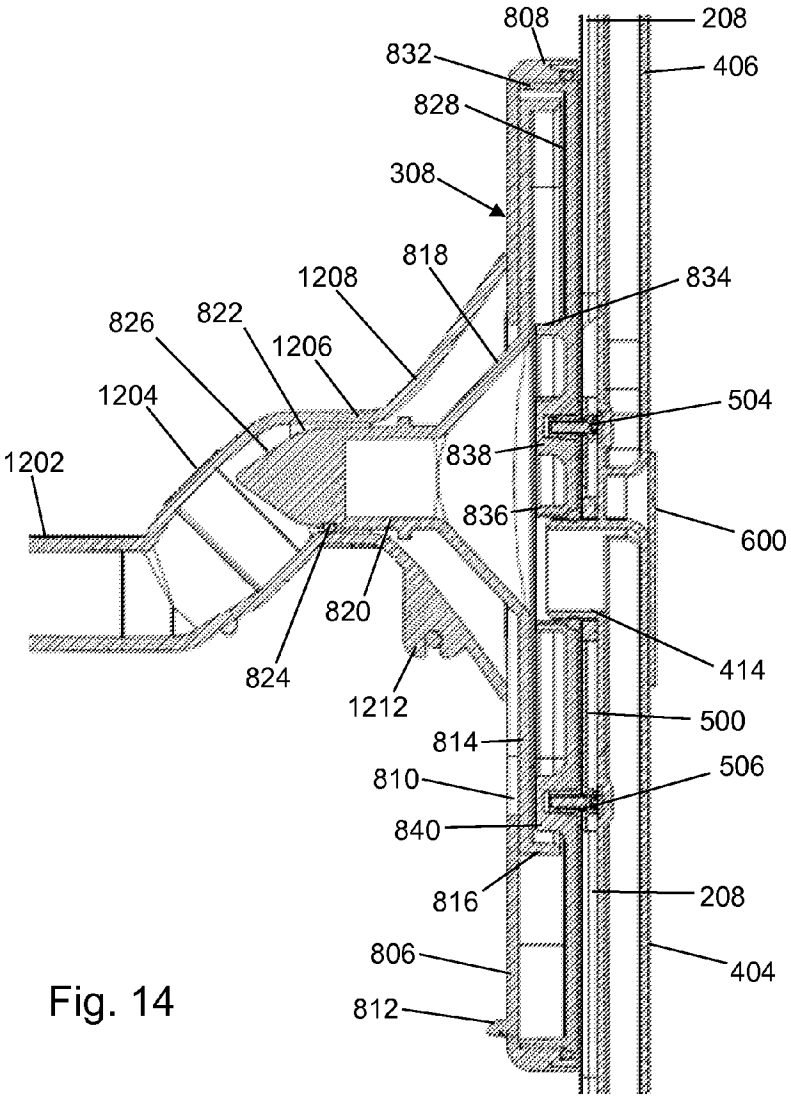
FIG. 14 depicts a right side cross sectional view of a spray arm docking system of the dishwasher of FIG. 1 in accordance with an illustrative embodiment with a sliding plate at a highest position.

With reference to FIG. 14, a right side cross sectional view of wall conduit system 308 mounted to basket conduit system 310 is shown in accordance with an illustrative embodiment with sliding plate 814 at a highest position.

Figure 15:
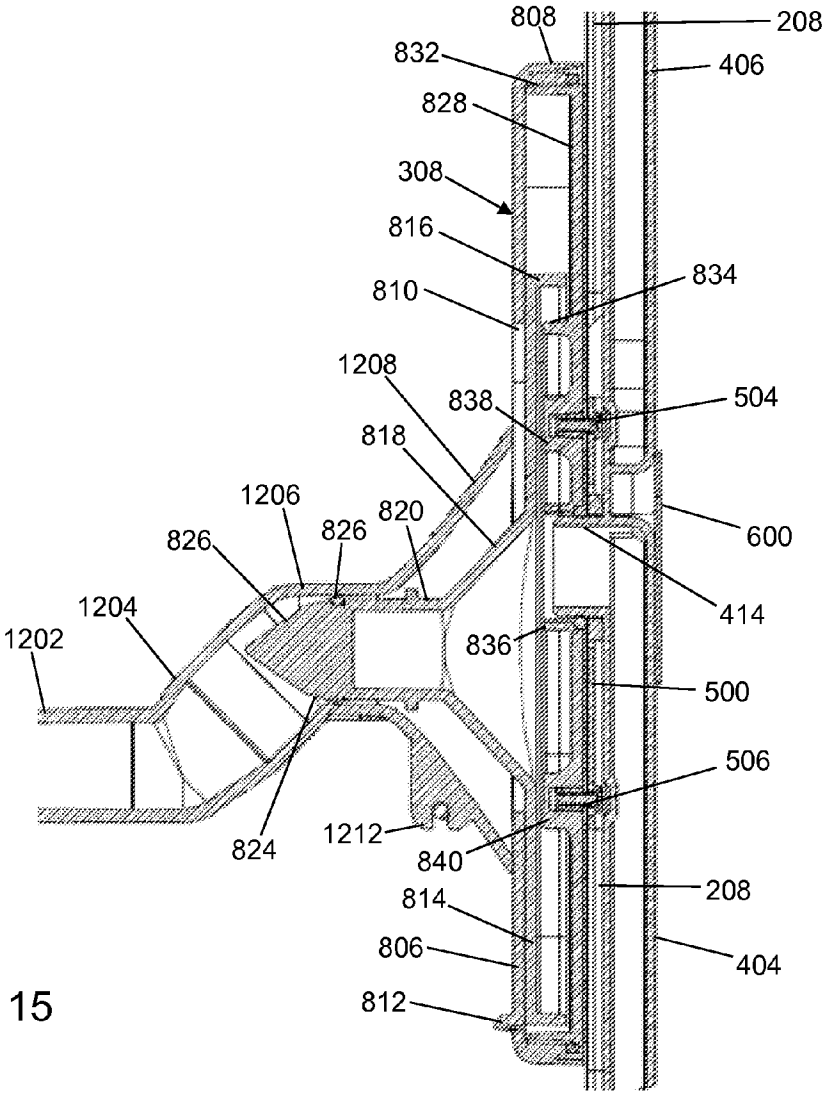
FIG. 15 depicts a right side cross sectional view of the spray arm docking system of FIG. 14 in accordance with an illustrative embodiment with the sliding plate at a lowest position.

With reference to FIG. 15, a right side cross sectional view of wall conduit system 308 mounted to basket conduit system 310 is shown in accordance with an illustrative embodiment with sliding plate 814 at a lowest position.

Depending on the relationship between the height of a center of fifth conduit section 1206 and the height of the protruding point of triangular plate 826, as top basket 214 is slid back into body 106, one of the protruding edges of triangular plate 826 may contact an interior surface of funnel shaped nozzle 1208. If one of the protruding edges of triangular plate 826 contacts an interior surface of funnel shaped nozzle 1208, sliding plate 814 moves either up or down within sliding aperture 810 of front plate 806 until second nozzle portion 820 is positioned within fifth conduit section 1206. Thus, the edges of triangular plate 826 ride either up or down the sloped side walls of shaped nozzle 1208 to guide second nozzle portion 820 into fifth conduit section 1206 of basket conduit system 310.

The circumference of oval shaped edge 1300 is larger than the second circumference of third nozzle aperture 1010 so that third nozzle aperture 1010 fits within oval shaped edge 1300. Third nozzle aperture 1010, from which first nozzle portion 818 extends, has an oval shape with a second circumference that fits within sliding aperture 810 of front plate 806 so that sliding plate 814 can slide up and down as top basket 214 is slid back into body 106. The second circumference of third nozzle aperture 1010 surrounds fifth nozzle 836, and thus, third nozzle 414 at any position sliding plate 814 slides within the space formed by front housing 800 and back housing 804.

When top basket 214 is pushed all the way back in place, sealing ring 824 on second nozzle portion 820 of fourth nozzle 817 seals against the inside cylindrical surface of fifth conduit section 1206 minimizing water leakage. Any water leakage from third nozzle 414 or fourth nozzle 817 drains out drain nozzle 1008. Sliding mechanism 802 allows for continuous adjustment of a height of top basket 214 within a specified range defined by third nozzle aperture 1010 regardless of the method of height adjustment of top basket 214.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A spray arm docking system comprising:

a basket conduit system configured to mount to a basket of a dishwasher, the basket conduit system comprising a conduit;

a first nozzle mounted to a first end of the conduit, the first nozzle configured to mount to an input nozzle of a spray arm of the dishwasher; and a second nozzle mounted to a second end of the conduit, wherein the second end is opposite the first end, and further wherein the second nozzle has a first funnel shape with a first circumference that decreases from an open end of the second nozzle towards the second end of the conduit; and a wall conduit system configured to mount to a wall of the dishwasher, the wall conduit system comprising a front housing comprising a front plate, wherein a sliding aperture is formed through the front plate;

a back housing comprising a back plate configured to abut the wall of the dishwasher, wherein a nozzle aperture is formed through the back plate and configured to receive a nozzle;

a sliding plate mounted between the front plate and the back plate to slide within a space formed by the front housing and the back housing, wherein an aperture is formed through the sliding plate; and a third nozzle sized and shaped to slide within the sliding aperture, the third nozzle comprising a first nozzle portion mounted to extend from the sliding plate in a direction towards the front housing and surrounding the aperture of the sliding plate; and a second nozzle portion mounted to extend from the first nozzle portion, the second nozzle portion comprising a conduit section having a generally cylindrical shape;

wherein the first nozzle portion has a second funnel shape with a second circumference that decreases from the sliding plate towards the conduit section of the second nozzle portion;

wherein the conduit section of the second nozzle portion extends within the second end of the conduit of the basket conduit system when the basket conduit system is mounted to the wall conduit system.

2. The spray arm docking system of claim 1, wherein the second nozzle portion further comprises a groove formed in an exterior wall of the conduit section, and the third nozzle further comprises a sealing ring mounted in the groove, wherein the sealing ring abuts an interior wall of the second end of the conduit of the basket conduit system when the basket conduit system is mounted to the wall conduit system.

3. The spray arm docking system of claim 1, wherein the front housing further comprises a drain nozzle formed through the front plate.

4. The spray arm docking system of claim 3, wherein a hood surrounds the drain nozzle and extends outward from the front plate.

5. The spray arm docking system of claim 4, wherein the front housing further comprises a first wall that extends from an edge of the front plate in a direction opposite the hood.

6. The spray arm docking system of claim 5, wherein the back housing further comprises a second wall that extends from an edge of the back plate to abut the first wall when the front housing is mounted to the back housing.

7. The spray arm docking system of claim 6, wherein the first wall and the second wall are fixedly mounted together.

8. The spray arm docking system of claim 1, wherein the back plate comprises an elastomeric material that forms a seal against the wall of the dishwasher.

9. The spray arm docking system of claim 1, wherein at least a portion of the nozzle aperture comprises an elastomeric material that forms a seal against the nozzle when the nozzle is inserted in the nozzle aperture.

10. The spray arm docking system of claim 1, wherein the third nozzle further comprises a triangular plate, wherein an edge of the triangular plate mounts across an opening of the second nozzle portion that is opposite the first nozzle portion.

11. The spray arm docking system of claim 1, wherein an opening of the first funnel shape forms a first oval.

12. The spray arm docking system of claim 11, wherein the first oval is larger than the sliding aperture in at least one dimension.

13. The spray arm docking system of claim 11, wherein an opening of the second funnel shape forms a second oval, wherein the first circumference of the first oval is larger than the second circumference of the second oval.

14. The spray arm docking system of claim 13, wherein the second oval is smaller than the sliding aperture in all dimensions.

15. The spray arm docking system of claim 13, wherein the second circumference of the second oval surrounds the nozzle aperture at any position the sliding plate slides within the space formed by the front housing and the back housing.

16. The spray arm docking system of claim 1, wherein a position of the sliding plate can be adjusted to any position within the space formed by the front housing and the back housing.

17. A dishwasher comprising:

a body;

a door;

a hinge pivotally mounting the door to the body;

a fluid supply system mounted to the body and comprising a pump;

a conduit mounted to the pump; and a nozzle extending from the conduit;

a basket slidably mounted within the body, wherein a height of the basket within the body is adjustable;

a spray arm comprising an input nozzle;

a basket conduit system mounted to the basket and comprising a basket conduit;

a first nozzle mounted to a first end of the basket conduit, the first nozzle configured to mount to the input nozzle of the spray arm; and a second nozzle mounted to a second end of the basket conduit, wherein the second end is opposite the first end, and further wherein the second nozzle has a first funnel shape with a first circumference that decreases from an open end of the second nozzle towards the second end of the basket conduit; and a wall conduit system mounted to a back wall of the body, the wall conduit system comprising a front housing comprising a front plate, wherein a sliding aperture is formed through the front plate;

a back housing comprising a back plate configured to abut the back wall, wherein a nozzle aperture is formed through the back plate and configured to receive the nozzle;

a sliding plate mounted between the front plate and the back plate to slide within a space formed by the front housing and the back housing, wherein an aperture is formed through the sliding plate; and a third nozzle sized and shaped to slide within the sliding aperture, the third nozzle comprising a first nozzle portion mounted to extend from the sliding plate in a direction towards the front housing and surrounding the aperture of the sliding plate; and a second nozzle portion mounted to extend from the first nozzle portion, the second nozzle portion comprising a conduit section having a generally cylindrical shape;

wherein the first nozzle portion has a second funnel shape with a second circumference that decreases from the sliding plate towards the conduit section of the second nozzle portion;

wherein the conduit section of the second nozzle portion extends within the second end of the basket conduit when the basket is slid into the body.

18. The dishwasher of claim 17, wherein the second nozzle portion further comprises a groove formed in an exterior wall of the conduit section, and the third nozzle further comprises a sealing ring mounted in the groove, wherein the sealing ring abuts an interior wall of the second end of the conduit of the basket conduit system when the basket is slid into the body.

19. The dishwasher of claim 17, wherein the back plate comprises an elastomeric material that forms a seal against the back wall.

20. The dishwasher of claim 17, wherein a position of the sliding plate can be adjusted to any position within the space formed by the front housing and the back housing.

* * * * *